United States Patent [19]

DeHart et al.

[11] 4,295,321

[45] Oct. 20, 1981

[54] ENVELOPE PROCESSING MACHINE

[75] Inventors: John R. DeHart, Coral Gables; Robert A. Majewski, Homestead, both of Fla.

[73] Assignee: Docutronix, Inc., Homestead, Fla.

[21] Appl. No.: 56,275

[22] Filed: Jul. 9, 1979

[51] Int. Cl.[3] ..... B65B 43/30

[52] U.S. Cl. ..... 53/381 R; 83/912; 271/276

[58] Field of Search ..... 53/381 R, 492; 83/912; 271/276; 198/694

[56] References Cited

U.S. PATENT DOCUMENTS

| | | | |
|---|---|---|---|
| 2,668,053 | 2/1954 | Bach | 53/381 R |
| 2,722,305 | 11/1955 | McCabe | 198/694 |
| 3,336,028 | 8/1967 | Schonmeier | 271/276 |
| 3,822,523 | 7/1974 | Russell et al. | 53/381 R |
| 3,986,455 | 10/1976 | Jeschke | 271/276 X |
| 3,989,577 | 11/1976 | Watson | 271/276 |
| 4,016,708 | 4/1977 | DeHart | 53/386 X |

*Primary Examiner*—John Sipos

*Attorney, Agent, or Firm*—McCormick, Paulding & Huber

[57] ABSTRACT

An extractor for removing contents from pre-opened envelopes which have two panels connected along three side edges and contents disposed in juxtaposition therebetween comprises an envelope magazine, a vacuum feed mechanism for sequentially withdrawing envelopes from the magazine and feeding the envelopes to cutter assemblies, which severs each successive envelope along opposite side edges to separate the panels thereof along said opposite side edges. The cutter assemblies feed the envelope into a separating mechanism which includes a rotatable vacuum drum. One panel of the envelope is gripped by and moves with the rotating drum whereas the other envelope panel and the envelope contents move away from the drum in a direction generally tangent to the drum. An edge of a cover on the machine serves as a reaction surface to hold the other envelope panel and causes extraction wheels at the discharge end of the machine to exert a swiping action upon the contents to discharge the contents in one direction along a path away from the envelope. The separator drum carries the envelope away in another direction and discharges it into a holding bin disposed within a table upon which the machine is supported.

17 Claims, 11 Drawing Figures

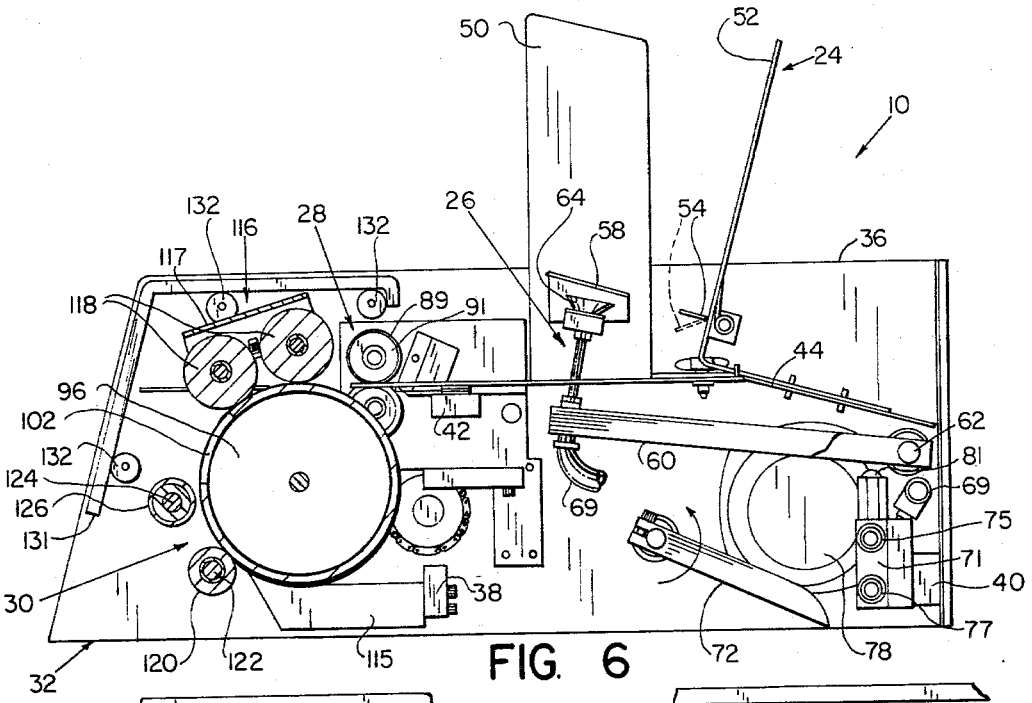
FIG. 6
FIG. 8
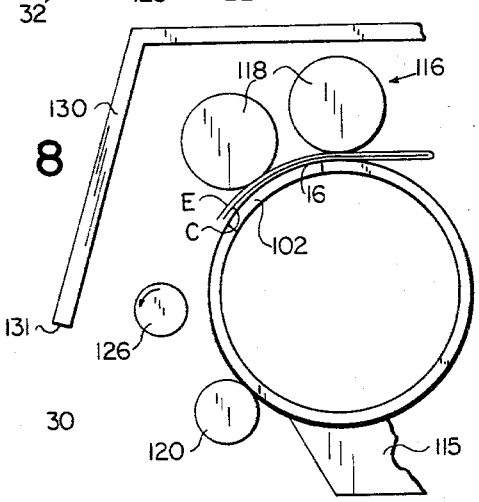
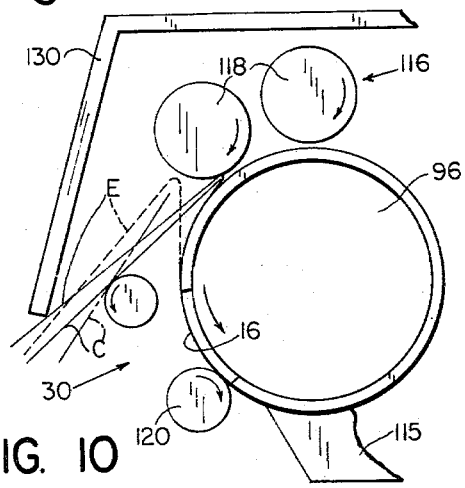
FIG. 10
FIG. 9
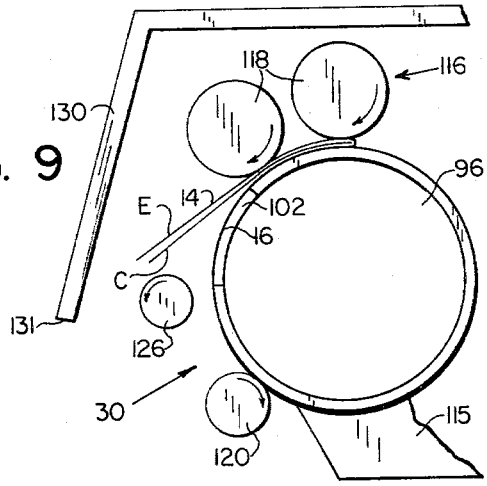
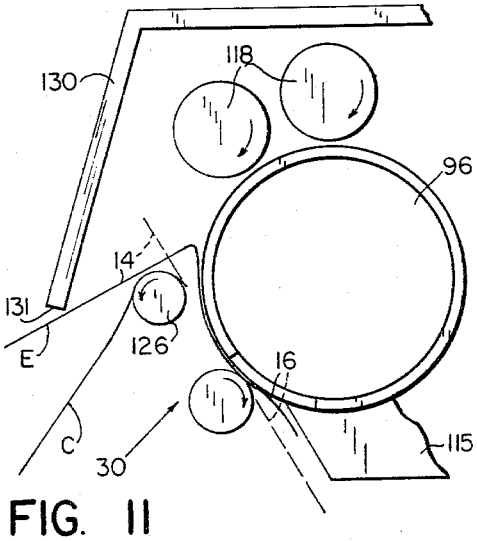
FIG. 11

ENVELOPE PROCESSING MACHINE

BACKGROUND OF THE INVENTION

This invention relates in general to envelope processing machinery and deals more particularly with an improved extractor for separating a pre-opened envelope from its contents.

The large volume of business reply mail handled today has created need for improved envelope processing machinery capable of processing large volumes of business reply mail to rapidly separate envelopes from envelope contents. A machine of the aforedescribed general type which separates contents from pre-opened envelopes is illustrated and described in U.S. Pat. No. 4,016,708, to DeHart, assigned to the assignee of the present application. The present invention is concerned particularly with improvements in such a machine which includes a magazine for containing a supply of pre-opened envelopes to be processed, a vacuum feeding mechanism for sequentially removing envelopes from the magazine, a cutting mechanism which receives each envelope from the feeding mechanism and severs connection between opposite side edges of the envelope panels leaving the envelope panels connected along a common fold line with the envelope contents disposed in juxtaposition between the panels, and a vacuum drum separator which receives each successive envelope from the cutting mechanism and separates the envelope from its contents, discharging the contents in one direction and the envelope in another direction from the machine. The aforedescribed vacuum drum has a plurality of vacuum ports which are elongated in an axial direction and open through the peripheral surface of the drum. Because of variations in the width (height) dimension of envelopes processed by the machine and/or the timing relationship between the feeding mechanism and the drum, envelopes may be fed onto the drum so that the leading edge of each envelope panel, which engages the vacuum drum, engages it slightly behind the forward end of the vacuum ports. When this condition occurs objectionable audible whistling sounds may be produced by air entering the drum through the vacuum slots past the leading edges of the envelope panels.

In a machine of the aforedescribed type a further problem may occur due to variations in the thickness of envelope contents. The vacuum pickup mechanism which pulls each envelope from the magazine will sometimes "bleed through" an envelope having thin contents and apply vacuum through the envelope and its contents to the next successive envelope in the magazine, causing two envelopes to be simultaneously pulled from the magazine. This double feed condition may cause a jamb to occur at the cutting mechanism requiring the machine to be stopped and the jamb cleared. While the present invention is primarily concerned with the aforedescribed problems, it is a further aim of the invention to provide an improved envelope processing machine of the aforedescribed general type, adapted for improved operator convenience, which utilizes substantially simpler mechanism than comparable machines of the prior art and which may be produced at relatively lower cost.

SUMMARY OF THE INVENTION

The present invention relates to an improved machine for separating pre-opened envelopes from envelope contents and which has an envelope magazine, severing means for cutting connections between panels of envelopes along opposite side edges, a feeding mechanism for successively feeding envelopes from the magazine to the severing means, and separating means for receiving each successive envelope from the severing means and including a cylindrical vacuum drum which has a plurality of vacuum ports in its peripheral surface for receiving successive envelopes from the cutting mechanism and for discharging the envelopes in one direction and the envelope contents in another direction from the machine. In accordance with the present invention the vacuum ports in the separator drum comprise a plurality of narrow, parallel slots opening through the peripheral surface of the drum, spaced apart in an axial direction, and extending in circumferential directions relative to the drum surface. The vacuum drum is driven in timed relation with the feeding mechanism and may be adjusted relative to the drive means to vary the timing relationship between the vacuum drum and the envelope feeding mechanism. In accordance with the further feature of the invention, the envelopes are at least partially supported in the magazine by a light spring. Withdrawal of an envelope from the magazine by the feeding mechanism causes the spring to be depressed. As an envelope being withdrawn clears the spring force stored in the spring is released causing the spring to engage the next successive envelope in the magazine, thereby separating the envelope being withdrawn from the next successive envelope in the magazine.

BRIEF DESCRIPTION OF THE DRAWINGS

FIG. 6 is a fragmentary sectional view taken along the line 6—6 FIG. 5.

FIGS. 8–11 are somewhat schematic views of the extractor and show successive positions of an envelope and its contents being processed by the extractor.

DETAILED DESCRIPTION OF PREFERRED EMBODIMENT

Figure 1:
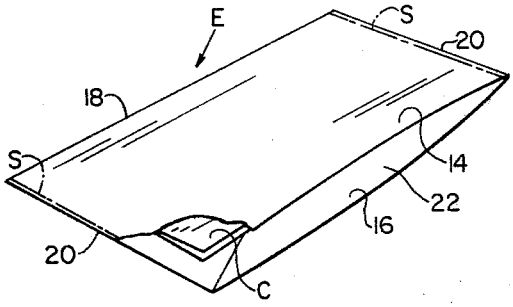
FIG. 1 is a perspective view of a typical opened envelope of the type processed by the machine of the present invention.

Turning now to the drawings, and referring first particularly to FIGS. 2–6, an extractor embodying the present invention and indicated generally by the reference numeral 10 is particularly adapted to separate contents from envelopes after the envelopes have been opened along one edge by a conventional envelope opening machine or the like. A typical envelope, indicated generally by the letter E in FIG. 1 and ready for processing by the extractor 10, has front and back panels 14 and 16, respectively, connected along a lower edge 18 and opposite side edges 20, 20. The envelope E has an opening 22 along its upper edge, such as formed by a conventional envelope opening machine or the like. The contents of the envelope, indicated by the letter C, are disposed in juxtaposition between the panels 14 and 16 and may, for example, comprise a piece of folded paper such as a letter.

The illustrated extractor 10 is supported on a table or stand, indicated generally at 12, and generally comprises a envelope magazine, designated generally by the numeral 24, for containing a supply of opened envelopes E, E arranged in vertically stacked relation. An envelope feed mechanism, indicated generally at 26, successively removes each envelope E from the magazine 24 and conveys it along a predetermined path to a severing or cutting mechanism, designated generally by the numeral 28, which cuts each advancing envelope E along its opposite side edges 20, 20 to sever the connections between the side edges of the panels 14 and 16 along lines of severance, which are indicated by the broken lines S, S in FIG. 1. A separating mechanism, indicated generally at 30, receives each severed envelope E from the cutter assembly 28 and, while advancing it, moves one of the envelope panels in a direction away from both the other of the panels and the envelope contents C and ultimately separates the severed envelope E from its contents C, discharging the envelope in one direction and the contents C in another direction from the machine, all of which will be hereinafter more fully discussed.

Considering now the extractor 10 in further detail, it has a frame, indicated generally at 32, which includes right and left hand side panels indicated at 34 and 36, respectively. The panels 34 and 36 are connected in transversely spaced apart relation by front and rear stabilizer bars 38 and 40 and a cutter mounting bar 42, best shown in FIG. 6. The frame 32 further includes a deck plate 44 which extends across the rear part of the machine and which has a forward portion shaped to accommodate the various mechanisms hereinafter further described. The deck plate 44 has a forwardly extending apron portion 45 which defines a portion of the envelope path.

The envelope magazine 24 comprises a hopper formed by a back stacker assembly, indicated generally at 46, and right and left hand end stacker plates 48 and 50 which are mounted on and extend upwardly from the deck plate 44. The back stacker assembly 46 includes a forwardly facing plate 52 which is upwardly and rearwardly inclined relative to the apron portion 45. A relatively light spring 54 is mounted on and extends forwardly through a slot in the lower portion of the plate 52. The forwardly extending portion of the spring 54 is biased to a position generally normal to the surface of the plate 52. The stacker plates 48 and 50 have opposing inwardly extending wings or tabs 56 and 58 formed thereon. The latter tabs are downward and rearwardly inclined in the direction of and generally normal to the forward surface of the plate 52, as it appears in FIG. 6.

Figure 4:
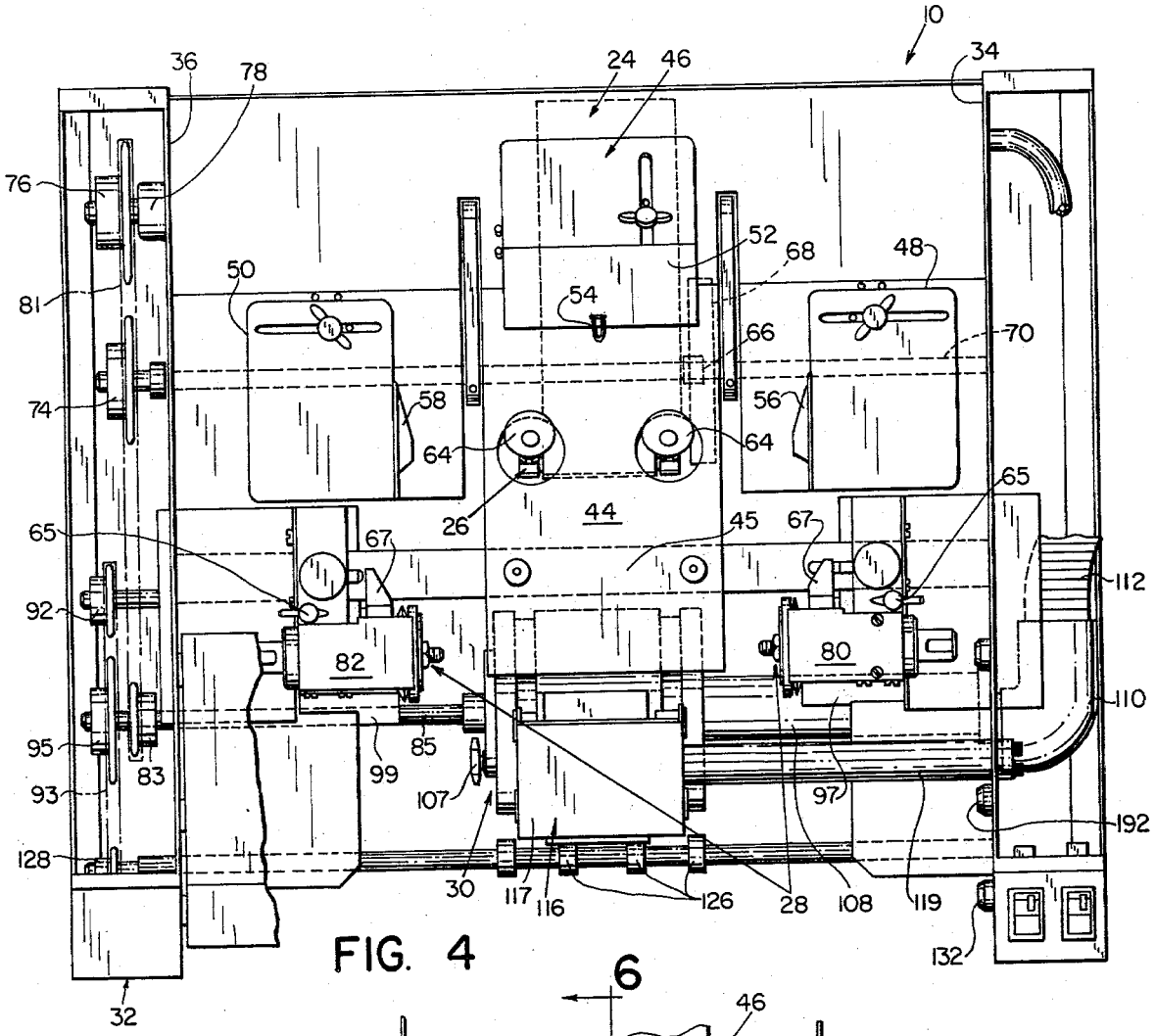
FIG. 4 is a somewhat enlarged plan view of the extractor of FIG. 2 shown with a portion of its cover broken away to reveal structure thereunder.

The envelope feeding mechanism 26 is arranged to remove successive envelopes from the bottom of a stack in the magazine 24 and includes a suction foot assembly which has an arm 60 supported at one end to pivot about a shaft 62 which extends transversely of the frame 32 at the rear end of the machine. A pair of transversely spaced apart and upwardly facing suction cups 64, 64 are mounted on the other end of the arm generally below the feed magazine 24 and are arranged to move upwardly through openings in the deck plate apron 45 as best shown in FIGS. 4 and 6. A roller follower 66 carried by the arm 60, and shown in FIG. 4, is engaged by a cam 68 mounted on a cam shaft 70 which is journalled on and extends transversely of the machine frame 32. A flexible hose 69 connected to the arm 60 and to a vacuum valve assembly 71, mounted on the rear stabilizer bar 40, communicates with ports which open through the suction cups 64, 64. The latter ports are selectively connected through the valve assembly 71 to a suction pump 73, mounted on the stand 12, by flexible hoses 75 and 77 connected, respectively to the vacuum and pressure sides of the pump 73. The valve 73 is operated by an actuator 81 in the path of the arm 60 to reverse the direction of fluid flow from the pump 73 to the ports in the suction cups 64, 64.

The envelope feed mechanism 26 further includes a pair of spaced apart accelerator arms 72, 72 mounted on the cam shaft 70 and arranged to travel upwardly in an arcuate path through slots in the deck plate 44, when the cam shaft 70 is rotated in counterclockwise direction from its position in FIG. 6. The table 12 has an opening 79 in its top, best shown in FIG. 2, which provides clearance to allow rotation of the accelerator arms 72, 72. The cam shaft 70 is driven by a sprocket 74 mounted on an end of the cam shaft and engaged with a drive chain 81 driven by another sprocket 76 mounted on a drive motor 78 which is attached to the machine frame below the deck plate 44. The drive chain 81 also drives another sprocket 83 mounted on a drum shaft 85 journalled on the side panel 36, and hereinafter further discussed.

The cutter mechanism 28 includes right and left hand cutter assemblies 80 and 82 supported on the cutter mounting bar 42, as best shown in FIG. 4, and arranged for transverse adjustment generally toward and away from each other. Each cutter assembly includes a cutter block 87, a pair of upper and lower rotary cutter blades 89, 89' and a pair of upper and lower rollers 91, 91' mounted on parallel shafts journalled for rotation in the cutter block. Wave spring washers positioned on the upper shaft bias the upper cutter blades 89, 89 axially toward the lower cutter blades 89, 89' so that the blades are supported for rotation in shearing relation to each other. The shafts which carry the lower cutter blades 89, 89' have drive sprockets 90, 90 mounted thereon. A cutter drive shaft 92 which is journalled on the machine frame and extends transversely thereof carries a pair of drive sprockets 94, 94 respectively connected by drive chains to the cutter drive sprockets 90, 90. The cutter drive shaft 92 is driven by another drive chain 93 engaged with a sprocket 95 mounted on the driven drum shaft 85. Each cutter assembly carries a transversely adjustable envelope guide 67 which is releasably secured by a clamping fastener 65. Each cutter assembly 80 and 82 also carries an associated scrap deflector 97, 99 for a purpose which will be hereinafter further discussed.

Figure 7:
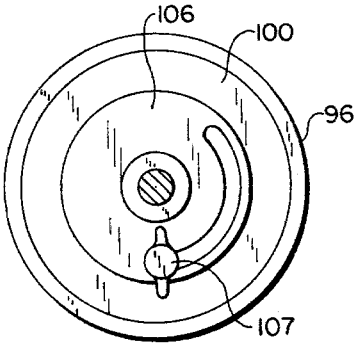
FIG. 7 is a somewhat enlarged fragmentary sectional view taken along the line 7—7 of FIG. 5.
Figure 3:
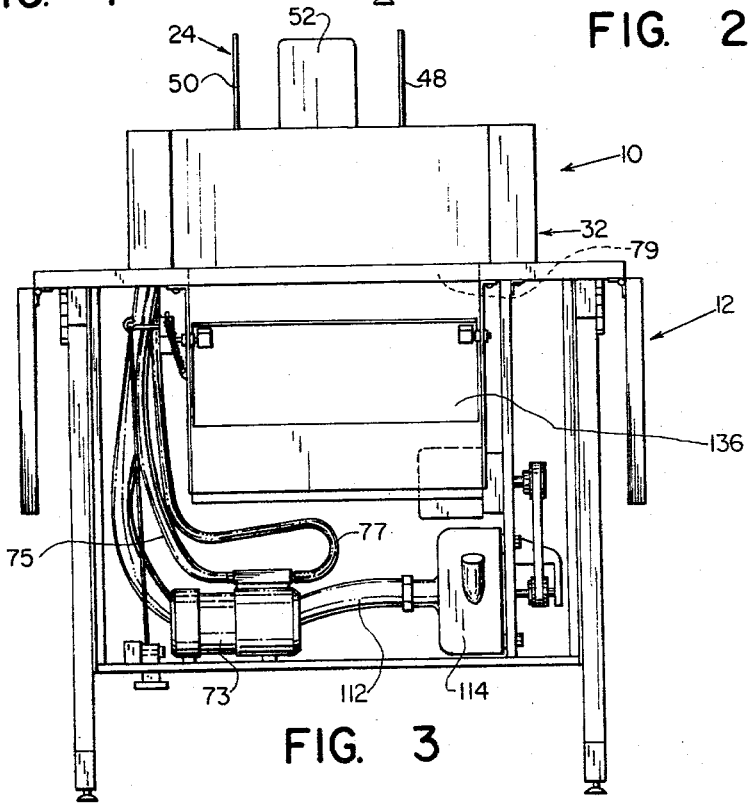
FIG. 3 is a rear elevational view of the extractor of FIG. 2.

The separating mechanism 30 includes a hollow cylindrical vacuum drum 96 which is closed at its opposite ends by circular end caps 98 and 100. The drum 96 has a plurality of circumferentially elongated slots 102, 102 formed therein which are spaced apart in an axial direction. A filter screen 104 disposed within the vacuum drum 96 overlies the various slots 102, 102 to prevent foreign material from being sucked into the drum. An adaptor flange 106 is mounted in fixed position on the inner end of the drum shaft 85. The flange 106 is releasably secured to the end cap 100 for angular adjustment relative thereto by a tee-knob 107 which extends through an arcuate slot in the flange 106 and threadably engages the end cap 100, as best shown in FIG. 7. The other end cap 98 is supported for rotation relative to a hollow tubular conduit 108 which is supported on the side plate 34 and which communicates with the interior of the vacuum drum. An elbow 110 connected to the outer end of the conduit 108 is, in turn, connected by a flexible duct 112 to a blower assembly 114 mounted in the lower portion of the stand 12.

The separator mechanism 30 further includes a drum follower assembly indicated generally at 116 and a pair of drum strippers 115, 115. The follower assembly comprises a pair of drum follower rollers 118, 118 supported above the vacuum drum 96. The follower rollers 118, 118 are mounted on a follower block 117 supported in cantilever position above the drum by a follower arm 119 secured to the side plate 34. The rollers 118, 118 are spring biased generally downwardly or toward the drum 96 and are arranged to roll freely in close proximity to the peripheral surface of the drum. The drum strippers 115, 115 are mounted in transversely spaced relation on the stabilizer bar 38 and compliment associated portions of the drum surface, as best shown in FIG. 6. A cylindrical pinch roller 120 is supported in generally rolling engagement with the lower portion of the drum 96 by another shaft 122 which is journalled on and extends transversely of the frame 32. The ends of the shaft 122 are carried by pivoted bearing blocks (not shown). Springs associated with the latter bearing blocks urge the roller 120 in the direction of the drum 96 so that the roller 120 is supported for limited movement generally toward and away from the drum surface. Another drive shaft 124 journalled on the frame 32 extends transversely of the machine forward of the drum 96 and carries a plurality of small friction rollers 126, 126. A drive sprocket 128 on the left hand end of the shaft 124, as it appears in FIG. 4, is driven by the chain 93. The shaft 124 is arranged to rotate at a somewhat greater rate than the drum shaft 85. The extractor 10 may be provided with an infinite range of speed control adjustment by utilizing a motor control circuit.

Figure 5:
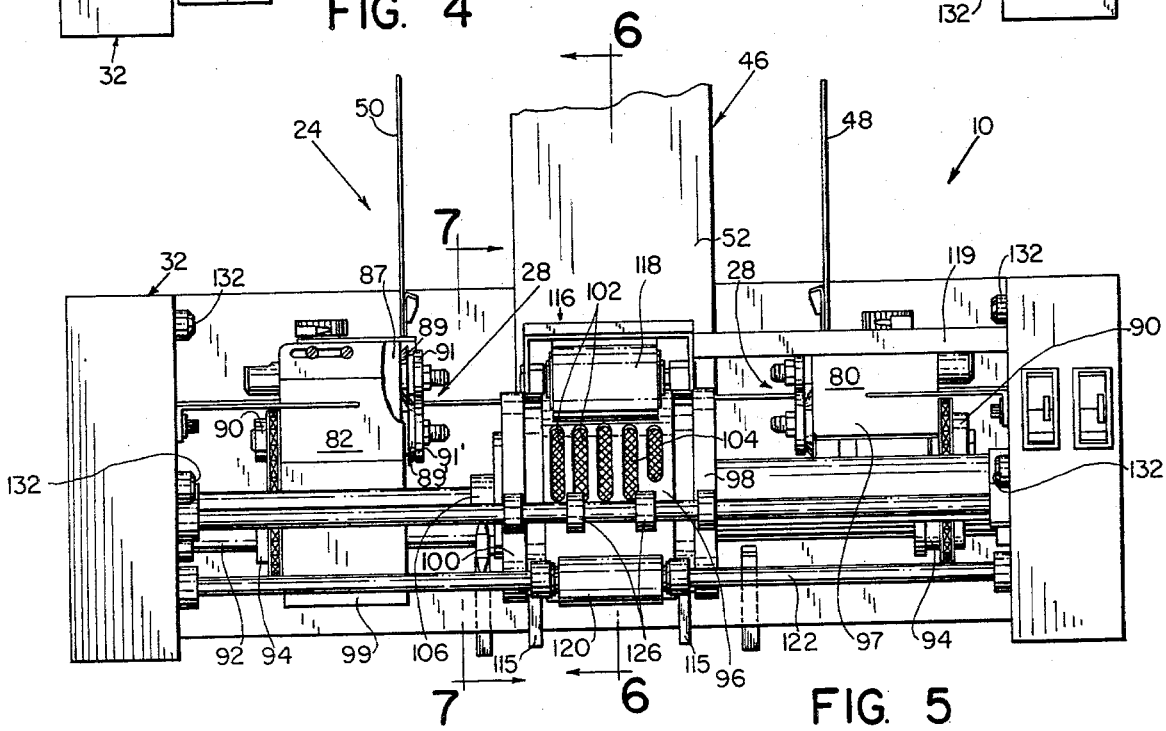
FIG. 5 is a somewhat enlarged fragmentary end elevational view of the extractor shown in FIG. 2.

The forward end of the machine 10 is partially enclosed by a removable cover 130 supported by a plurality of rubber bumpers 132, 132 which are mounted on the side panels 34 and 36, substantially as shown in FIGS. 4 and 5. The lower edge of the cover defines a downwardly facing abutment surface 131 for a purpose to be hereinafter described. As previously noted, the top of the table or stand 12 has an opening 79 therethrough. The latter opening communicates with a chute 134 which has a pedal operated chute door 136 movable between closed and open positions indicated respectively by full and broken lines in FIG. 2, and normally spring biased in its closed position. The forward end of the opening 79 is defined by a bin door 138 connected to the table top by a spring hinge 140. The hinge normally biases the bin door 138 to its full line position of FIG. 2 wherein it defines a portion of the table surface, however, the bin door may be pivoted to its broken line position for access to a scrap holding bin formed by the chute 134 and the chute door 136 in its closed position.

Preparatory to operation, the extractor 10 is adjusted, as necessary, to accommodate the particular envelopes to be processed. The envelope magazine 24 is adjusted by loosening tee-knobs which secure the back stacker assembly 46 and the end stacker plates 48 and 50 to the deck plate 44. The back stacker assembly 46 is moved forwardly or rearwardly, as necessary, so that the suction cups 64, 64 will properly engage an envelope to be contained in and at the bottom of the magazine 24. The end stacker plates 48 and 50 transversely adjusted to generally engage opposite side edges of the envelopes to be positioned in the magazine. The envelope guides 69, 69 are also adjusted to engage opposite side edges of the envelopes. The cutter assemblies 80 and 82, which are releasably secured to the cutter mounting bar 42, are transversely adjusted to sever each envelope E, advanced by the feed mechanism 26, along lines of severance S, S inwardly of its opposite side edges 20, 20. The cutter blocks 87, 87 may be transversely adjusted relative to the envelope guides 69, 69 whereby the width of the side edge portions to be severed from the envelopes may be varied. Since envelopes processed by the machine 10 may vary in height (width) it may be necessary to adjust the angular position of the vacuum drum 96 relative to the drum shaft 85, so that leading edge of the lower panel of each envelope E picked up by the vacuum drum will engage the drum ahead of the slots 102, 102 whereby the lower panel of the envelope will substantially cover the slots in the drum. This adjustment is made by loosening the tee-nut 107, rotating the drum 96 in either direction, as necessary, relative to the adaptor flange 106, and retightening the tee-nut 107 when the drum is in proper angular position relative to the drum shaft 85. Adjusting the drum 96 in the aforedescribed manner adjusts timing between the drum 96 and the accelerator fingers 72, 72, as will be hereinafter evident.

Envelopes E, E are stacked in the magazine 24 with the openings 22, 22 thereof facing in a forward direction. When the machine is operated the drive motor 78, the vacuum pump 73 and the blower assembly 114 operate continuously. Rotation of the cam 68 by the drive motor 78 causes the arm 60 to pivot upwardly from its position of FIG. 6 to bring the suction cups 64, 64 into gripping engagement with the downwardly facing panel of the lowermost envelope in the magazine 24. As the suction cups 64, 64 move upwardly the position of the valve assembly 71 is such that the suction cups are connected to the vacuum side of the pump 73. Upon engagement with an envelope E in the magazine, the suction cups 64, 64 begin to move downward and exert a downward pull on the lowermost envelope E in the magazine, which envelope is supported in the magazine by the tabs 56 and 58 on the end stacker plates and the spring 54 of the back stacker assembly 46. As an envelope E is pulled from the magazine by the suction cups 64, 64 the spring 54 is forced downward toward its broken line position of FIG. 6. The spring is held in a downward position until the envelope being pulled from the magazine has passed it. Since thickness of the envelope contents may vary, the vacuum pressure applied by the two suction cups 64, 64 may often "bleed through" an envelope with thinner contents, thus also capturing a second envelope immediately thereabove in the magazine. In this instance, when the first envelope E passes the tip of the spring 54 some spring tension is released. This released spring force is generally sufficient to break the vacuum seal on the second envelope, thereby retaining the second envelope in the magazine. When the arm 60 reaches the bottom of its stroke the envelope carried by the suction cups is deposited on the apron portion 45.

While the suction cups 64, 64 travel downwardly the accelerator arms 72, 72 which are also driven by the cam shaft 70 move upwardly in a counterclockwise direction from the position shown in FIG. 6 and through the deck plate 44 and into engagement with the lower edge 18 of an envelope E on the deck plate. The arm 60 which simultaneously pivots in counterclockwise direction from its position in FIG. 6 engages the actuator 79 of the valve assembly 71 causing the suction cups 64, 64 to release the envelope. Actuation of the valve assembly 71 disconnects the suction cups from the vacuum side and connects the suction cups to the pressure side of the pump 73 whereby air under pressure is forced through the lines to the suction cup ports clearing the ports and the associated lines. The accelerator arms 72, 72 push the envelope along the apron portion 45, between the guides 69, 69 which straighten an envelope if skewed relative to its predetermined path, and into nips between the upper and lower rollers 91, 91' and the upper and lower cutter blades 89, 89'. The rollers 91, 91' then advance the envelope E while the cutters simultaneously sever the connections between the panels 14 and 16 along the opposite side edges 20, 20 along the lines of severance S, S. The upper cutter blades 89, 89 move axially against the bias of the wave spring washers and relative to the lower blades 89', 89' to compensate for any unusual envelope side edge thickness. The scrap deflectors 97 and 99 prevent the sheared-off opposite side edge portions of the envelope from advancing and direct these sheared-off portions through the opening 97 and into scrap holding bin.

As the severed envelope leaves the cutters the leading edges of the envelope panels are fed into the nip between the rotating vacuum drum 96 and the rear drum follower roller 118. When the vacuum drum 96 is properly timed relative to the accelerator arms 72, 72, as previously described, the leading portion of the envelope engages the vacuum drum at least one-eighth inch beyond the forward ends of the slots 102, 102. The drum 96 applies a relatively low pressure high volume vacuum over a comparatively large area of the envelope surface. The use of low pressure high volume vacuum substantially eliminates risk that the contents C will be held by vacuum against the envelope panel adjacent the drum surface, regardless of paper thickness or weight of either envelope or contents. In the event that an envelope engages the drum 96 with its leading edge slightly behind the forward ends of the slots 102, 102 no audible whistling sound is produced by air drawn into the drum past the leading edge of the envelope, because the drum material between the narrow slots prevents the envelope leading edge from fluttering and producing such objectionable sound.

Referring now to FIGS. 8–11, the path of an envelope E and contents C through the separator mechanism 30 is shown. As the envelope and its contents pass the follower assembly moving from the position of FIG. 8 to the position of FIG. 9, it will be noted that the illustrated envelope panel 16, that is the panel in engagement with the drum 96, follows the path of the drum, whereas the other envelope panel 14 and the contents C tend to move along a path generally tangent to the drum surface. It will be noted that the vacuum slots 102, 102 grip only the leading portion of the envelope panel 16. Thus, when the envelope E is released by the drive follower assembly the trailing portion of the panel 18 flips forward to the general position shown in broken lines in FIG. 10. When the envelope E and contents C advance to the position shown in FIG. 10, the leading end of the envelope is advanced beyond the cover lower edge 131. The vacuum drum 96, which rotates in counterclockwise direction, as shown in FIG. 10, exerts a downwardly directed pulling force upon the panel 16 engaged therewith while the abutment surface 131 functions as a reaction surface for holding down an associated end portion of the other envelope panel 14, thereby tending to force the contents C into frictional engagement with the extraction wheels 126, 126 which have a linear speed greater than the linear speed of the drum 96. These extraction wheels aid to positively separate the contents from the envelope, as shown in FIG. 11. The envelope continues to follow the drum along a path between the drum and the pinch roller 120. The angular spacing between the pinch roller 120 and the drum follower assembly 16 is such that the leading edge of the envelope panel 16 engages the nip between the pinch roller 120 and the separator drum 96 before the folded trailing edge of the envelope E clears the drum follower assembly 16. At this point the leading edge of the envelope engages the drum strippers 115, 115 which separate the envelope from the drum and guides it in a direction generally indicated by broken lines in FIG. 11 toward and through the opening 79 into the holding bin. The ejector 10 may be provided with a candling device for detecting whether the contents has been wholly separated from the envelope for providing a signal to alert the operator to stop the machine in the event that contents are ejected into the holding bin. If the machine is provided with such a detector/candler option the drum strippers 115, 115 are eliminated and replaced by the optional device. Such detecting apparatus is well known in the art and is shown in U.S. Pat. No. 4,016,708, hereby adopted by reference, and for a more complete disclosure of a candling device reference may be had to the aforesaid patent.

Figure 2:
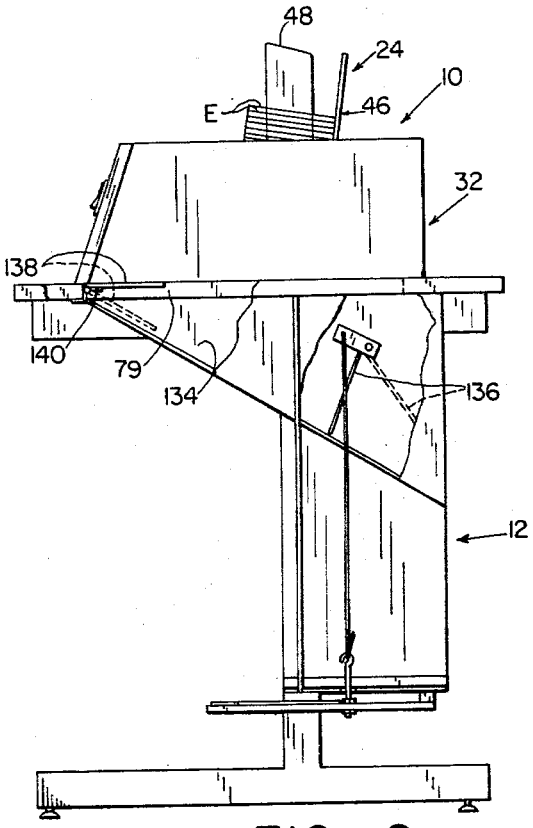
FIG. 2 is a side elevational view of an extractor embodying the present invention.

In the event that envelope contents are accidentally ejected into the holding bin, the machine operator may reach into the holding bin from the front of the machine to retrieve the envelope and/or its contents by depressing the bin door 138 from its full to its broken line position of FIG. 2. After the material has been retrieved from the holding bin the spring hinge 140 biases the bin cover 138 to its full line position of FIG. 1 wherein it defines a portion of the table surface. The holding bin may be emptied by depressing a foot pedal thereby opening the spring loaded chute door 136 at the rear of the machine allowing the empty envelope and chad in the holding bin to slide down the chute and into a trash container (not shown) positioned at the rear of the machine.

We claim:

1. In a machine for advancing a pre-opened envelope and separating the envelope from its contents, the envelope having two panels defining an opening therebetween along a leading edge of the envelope and connected together along the remaining edges of the envelope, the machine having feeding means for receiving and advancing an envelope along a generally predetermined path, severing means disposed along the path for engaging the advancing envelope and cutting it inwardly of its opposite side edges to sever connections between the panels along opposite side edges thereof leaving one panel connected to the other panel along a trailing edge opposite the one edge and the contents in juxtaposition between the two panels, and separating means disposed to receive the severed envelope and its contents from the severing means and including a cylindrical vacuum drum having vacuum ports opening through its peripheral surface for engaging and holding the one panel in engagement with an associated portion of the peripheral surface of the drum, drive means for rotating the drum about its axis to advance the severed envelope and move it in a direction away from its contents, and a follower roller journalled for rotation about an axis parallel to the axis of said drum, said follower roller and said drum defining a nip therebetween through which said advancing severed envelope and its contents are constrained to pass, the improvement wherein said separating means includes an extraction roller journalled for rotation about an axis parallel to said drum axis and angularly spaced about said drum axis from said follower roller axis and in the direction of drum rotation for engaging the contents as the contents advances through said nip and along a path generally tangent to the peripheral surface of said drum, means for rotating the extraction roller about its axis, and abutment means in the path of the leading edge of the other panel for engaging the other panel as it advances through said nip and along a path generally tangent to the peripheral surface of said drum and biasing the other panel toward the contents and the extraction roller to urge the contents toward engagement with the extraction roller.

2. In a machine for separating a pre-opened envelope from its contents as set forth in claim 1 the further improvement wherein said vacuum ports comprise a plurality of slots elongated in circumferential directions and spaced apart in an axial direction.

3. In a machine for separating a pre-opened envelope from its contents as set forth in either claim 1 or claim 2 the further improvement wherein said separating means includes a pinch roller journalled for rotation about an axis parallel to said drum axis and angularly spaced about said drum axis and from said extraction roller axis in the direction of drum rotation, said drum and said pinch roller cooperating to form a nip therebetween.

4. In a machine for separating a pre-opened envelope from its contents as set forth in claim 1 and wherein said feeding means includes a magazine for containing pre-opened envelopes, and suction means including a suction cup having a port therethrough for withdrawing an envelope from said magazine and advancing it along said predetermined path and means for drawing air through said port when said suction cup is engaged with an associated envelope, the improvement comprising means for reversing the flow of air through said port when said suction cup is out of engagement with an envelope.

5. In a machine for separating a pre-opened envelope from its contents as set forth in claim 1 the further improvement wherein said feeding means includes a magazine for containing a stack of pre-opened envelopes and means for withdrawing each successive envelope from the bottom of the stack and advancing it along said predetermined path the improvement comprising a spring partially defining the bottom of said magazine and providing support for the envelopes stacked therein, said spring being downwardly biased in response to removal of an envelope from said magazine by said withdrawing means.

6. In a machine for separating a pre-opened envelope from its contents as set forth in claim 1 the improvement wherein said machine includes a table having a top supporting said machine and having an opening in said top for receiving envelopes separated by said separating means and a bin disposed below said opening and partially defined by a downwardly directed chute and a chute door normally biased to a closed position and a pedal operable to open said chute door.

7. In a machine for separating a pre-opened envelope from its contents as set forth in claim 2 wherein said drive means comprises means for driving said drum in timed relation to the operation of said feeding means the further improvement comprising means for adjusting the angular position of said drum relative to said driving means to vary the timing relationship between said vacuum drum and said feeding means.

8. In a machine for separating a pre-opened envelope from its contents as set forth in claim 2 the further improvement wherein said drive means includes a drive shaft and a flange mounted in fixed position on said shaft and said means for adjusting the angular position of said drum comprises a clamping fastener extending through an arcuate slot in said flange and releasably securing said drum in selected angular position relative to said flange.

9. In a machine for separating a pre-opened envelope from its contents as set forth in claim 5 the further improvement wherein said magazine includes a plurality of plates extending upwardly from said path for generally engaging associated edges of envelopes contained in said magazine and wherein said spring is carried by one of said plates.

10. In a machine for separating a pre-opened envelope from its contents as set forth in claim 9 the further improvement wherein said plates include a pair of opposing end stacker plates for general engagement with opposite side edges of envelopes contained in said magazine and a forwardly facing back stacker plate for engaging the edge of each envelope opposite its one edge and said spring projects forwardly in cantilever position from said back stacker plate.

11. In a machine for separating a pre-opened envelope from its contents, as set forth in claim 10 the further improvement wherein the bottom of said magazine is further defined by upwardly facing tabs projecting inwardly from said end stacker plates.

12. In a machine for separating a pre-opened envelope from its contents as set forth in claim 1 the further improvement wherein said abutment means defines a downwardly facing abutment surface spaced forwardly of said cylindrical vacuum drum and said extraction roller is journalled for rotation between said abutment surface and said drum.

13. In a machine for separating a pre-opened envelope from its contents as set forth in claim 12 the further improvement comprising a cover at the forward end of said machine having a lower edge extending in a direction parallel to the axis of said drum and defining said abutment surface.

14. In a machine for separating a pre-opened envelope from its contents as set forth in claim 4 the further improvement wherein said means for moving said suction cup comprises an arm supported for pivotal movement relative to said magazine and carrying said cup and said means for reversing the direction of air flow comprises a valve having an actuator disposed in the path of said arm.

15. In a machine for separating a pre-opened envelope from its contents as set forth in claim 6 the further improvement comprising a bin door hingedly connected to the table top for movement between open and closed position and normally biased to said closed position, said bin door in the said closed position defining a portion of said table top and a portion of said opening therein.

16. In a machine for separating a pre-opened envelope from its contents as set forth in claim 6 wherein said severing means comprises a pair of spaced cutter assemblies the further improvement comprising a deflector plate disposed forwardly of each of said cutter assemblies for halting the advance of scrap material severed from opposite side edge portions of an envelope and directing said material downwardly through said opening.

17. In a machine for separating a pre-opened envelope from its contents, as set forth in claim 1 including a table having a top supporting said machine, the further improvement wherein said table has an opening through said top and through which the separated envelope moved by said separating means is constrained to pass and means defining a bin below said opening for receiving the separated envelope.

* * * * *